US007806946B2

(12) United States Patent
Lack

(10) Patent No.: US 7,806,946 B2
(45) Date of Patent: Oct. 5, 2010

(54) ADDITIVES FOR HYDROCARBON FUELS

(76) Inventor: Lloyd Lack, P.O. Box 1694, Battle Creek, MI (US) 49016-1694

( * ) Notice: Subject to any disclaimer, the term of this patent is extended or adjusted under 35 U.S.C. 154(b) by 853 days.

(21) Appl. No.: 11/576,419

(22) PCT Filed: Oct. 19, 2005

(86) PCT No.: PCT/US2005/037534

§ 371 (c)(1),
(2), (4) Date: Mar. 30, 2007

(87) PCT Pub. No.: WO2006/044936

PCT Pub. Date: Apr. 27, 2006

(65) Prior Publication Data

US 2007/0251142 A1 Nov. 1, 2007

Related U.S. Application Data

(63) Continuation-in-part of application No. 10/075,506, filed on Feb. 13, 2002, now abandoned.

(60) Provisional application No. 60/619,993, filed on Oct. 19, 2004.

(51) Int. Cl.
*C10L 1/22* (2006.01)
*C10L 1/18* (2006.01)

(52) U.S. Cl. ..... 44/412; 44/369; 44/380; 44/439

(58) Field of Classification Search ..... 44/412, 44/439, 369, 380
See application file for complete search history.

(56) References Cited

U.S. PATENT DOCUMENTS

| | | | | | |
|---|---|---|---|---|---|
| 3,383,328 | A | * | 5/1968 | Baker et al. | 252/390 |
| 3,877,887 | A | | 4/1975 | Moore et al. | |
| 4,131,433 | A | | 12/1978 | Scott | |
| 5,266,082 | A | | 11/1993 | Sanders | |
| 5,401,325 | A | | 3/1995 | Mihelic et al. | |
| 5,501,807 | A | | 3/1996 | Benda | |
| 5,669,938 | A | | 9/1997 | Schwab | |
| 5,723,430 | A | * | 3/1998 | Mihelic | 510/417 |
| 5,782,936 | A | | 7/1998 | Riley | |
| 5,823,758 | A | | 10/1998 | Lack | |
| 6,268,315 | B1 | | 7/2001 | Baca et al. | |

FOREIGN PATENT DOCUMENTS

| | | |
|---|---|---|
| WO | WO/00/23542 | 4/2000 |

* cited by examiner

*Primary Examiner*—Cephia D Toomer
(74) *Attorney, Agent, or Firm*—Weiner & Burt, P.C.; Irving M. Weiner; Pamela S. Burt

(57) ABSTRACT

An additive for hydrocarbon fuels such as LPG, gasoline, and diesel fuel. The additive includes a hydrocarbon mixture, an alkyl amine, and at least one vapor phase inhibitor.

18 Claims, No Drawings

ADDITIVES FOR HYDROCARBON FUELS

The present patent application claims priority from U.S. Provisional Patent Application Ser. No. 60/619,933 filed on Oct. 19, 2004, which is a continuation-in-part of and claims priority from U.S. patent application Ser. No. 10/075,506 filed Feb. 13, 2002 (now abandoned), which in turn is a continuation-in-part of U.S. Provisional Patent Application Ser. No. 60/288/812 filed May 4, 2001.

The present invention relates generally to certain new and useful improvements in additives for hydrocarbon fuels such as LPG, gasoline, and diesel fuel.

More particularly, the present invention relates to improved additives for hydrocarbon fuels, wherein the additives include a predetermined amount of a predetermined hydrocarbon mixture, a predetermined amount of a predetermined alkyl amine, and a blend of vapor phase inhibitors.

BACKGROUND OF THE INVENTION

Liquid petroleum gases (LPG), which are primarily comprised of propane and butane, are widely used as engine fuels. These products are obtained from natural gas and crude oil processing operations and are generally classified as LPG, propane, butane, and butane-propane mixtures in accordance with specifications published by the Gas Processors Association.

The relevant art concerning additives for LPG fuels is exemplified by U.S. Pat. No. 5,782,936 and applicant's prior U.S. Pat. No. 5,823,758.

It is a desideratum of the present invention to avoid the animadversions of previous additives.

More particularly, the present invention achieves the objects and purposes of applicant's prior U.S. Pat. No. 5,823,758 but without the use of metal oxide catalysts, and yet accomplishes same while avoiding and/or minimizing precipitating out of any components.

SUMMARY OF THE INVENTION

The present invention provides an additive for hydrocarbon fuels, such as LPG, gasoline, and diesel fuel, wherein said additive comprises: a predetermined amount of a predetermined hydrocarbon mixture; a predetermined amount of a predetermined alkyl amine; and at least one vapor phase inhibitor.

The present invention also provides new and improved additives for hydrocarbon fuels, comprising active components including a hydrocarbon mixture in the range of approximately 75% to 78% by volume, an alkyl amine in the range of approximately 5% to 8% by volume, at least one predetermined vapor phase inhibitor, and at least one predetermined surfactant.

One of the primary objects of the present invention is to provide improved additives as described hereinabove which permit substantially complete oxidation of the hydrocarbon fuels to be achieved even when the hydrocarbon fuels contains significant quantities of impurities such as sulfur, water, propylene, long chain hydrocarbons, etc.

It is another object of the present invention to provide improved additives as described hereinabove which substantially reduce or eliminate polluting emissions normally caused by incomplete oxidation, while simultaneously reducing emissions of nitrogen oxides.

Another object of the present invention is to provide improved additives as described hereinabove which minimizes and/or avoids any settling out or precipitating out of any substances and/or components.

It is a further object of the present invention to provide improved additives as described hereinabove which accomplishes the aforementioned objects without the use of metal oxide catalysts.

Another object of the present invention is to provide improved additives as described hereinabove which increase heating value after vaporization.

Another object of the present invention is to provide improved additives as described hereinabove which increase burning velocity in oxygen.

Another object of the present invention is to provide improved additives as described hereinabove which provide an exothermic formation reaction to accommodate efficiencies of primary and secondary combustion.

The present invention possesses many advantages and features which will become more apparent to those persons skilled in this area of technology and others when reading the detailed description of the preferred embodiments of the present invention as set forth hereinbelow.

DETAILED DESCRIPTION OF THE PREFERRED EMBODIMENTS OF THE INVENTION

In accordance with a preferred embodiment of the present invention, there is provided an additive for hydrocarbon fuels, comprising active components including a hydrocarbon mixture in the range of approximately 75% to 78% by volume, an alkyl amine in the range of approximately 5% to 8% by volume, at least one predetermined vapor phase inhibitor, at least one predetermined surfactant, and one or more ingredients.

Preferably, but not necessarily, the additive may include the following active components: hydrocarbon mixture; hydrophilic molecules; a surfactant; a ketone, an alkyl amine; an aromatic hydrocarbon; and a vapor phase inhibitor.

In accordance with some preferred embodiments of the present invention, the improved additive would include the following active components:

| | |
|---|---|
| hydrocarbon mixture | 75% to 78% by volume; |
| alkyl amines | 5% to 8% by volume; |
| aromatic hydrocarbon | 1% to 3% by volume; |
| vapor phase inhibitor | 5% to 8% by volume; |
| surfactant | 1% to 3% by volume; and |
| hydrophilic molecules | 1% to 3% by volume. |

The aforementioned hydrocarbon mixture may preferably comprise any suitable hydrocarbon mixture, such as, for example, stoddard solution-low VOCs.

The aforementioned surfactant may preferably comprise any suitable surfactant, such as, for example, magnesium lauryl sulfate.

The aforementioned alkyl amine may preferably comprise any suitable alkyl amine, such as, for example, N-methyldiethanolamine.

The aforementioned aromatic hydrocarbon may preferably comprise any suitable aromatic hydrocarbon, such as, for example, a high K-B (Kari-Butyl) solvent, like Terpines.

The aforementioned vapor phase inhibitor may preferably comprise any suitable vapor phase inhibitor, such as, for example, sodium lauryl sulfate or an amine phosphate.

The surfactant is incorporated to absorb and/or pass through moisture and fuel impurities.

Two specific examples of the invention are set forth below.

Example # 1

75% Hydrocarbon mixture, i.e. (stoddard solvent—low VOC's)

8% Vapor phase inhibitor, i.e. (sodium lauryl sulfate)

3% Surfactant, i.e. (magnesium lauryl sulfate)

8% Alkyl amines, i.e. N-methyldiethanolamine

1% Hydrophilic molecules, i.e. (Polarized H-bonding)

3% Aromatic hydrocarbon, i.e. (Kari-Butyl Terpines)

2% Ketones, i.e. (MEK, MIBK, acetone)

Example # 2

78% Hydrocarbon mixture

8% Vapor phase inhibitor

3% Surfactant

8% Alkyl amines

1% Hydrophilic molecules

2% Aromatic hydrocarbon

The additives in accordance with the present invention provide hydrophobic tail structures for rapid vaporization.

Although the additives in accordance with present invention may be effectively used with any hydrocarbon fuel, the present invention is particularly suitable as an additive for LPG.

There have described hereinabove only certain preferred embodiments of the present invention which can be formulated in many different ways. It should be understood that many changes, modifications, variations, and other uses and applications will become apparent to those persons skilled in this particular area of technology and to others after having been exposed to the present patent applications.

Any and all such changes, modifications, variations, and other uses and applications which do not depart from the spirit and scope of the present invention are therefore covered by and embraced within the scope of the patent claims set forth hereinbelow.

The invention claimed is:

1. An additive for LPG, wherein said additive comprises the following active components:

a hydrocarbon mixture present in the range of approximately 75% to 78% by volume;

an alkyl amine present in the range of approximately 5% to 8% by volume;

a vapor phase inhibitor; and a surfactant.

2. An additive according to claim 1, including:

hydrophilic molecules;

a ketone; and an aromatic hydrocarbon.

3. An additive according to claim 1, including:

an aromatic hydrocarbon present in the amount of approximately 1% to 3% by volume;

said vapor phase inhibitor being present in the amount of approximately 5% to 8% by volume;

said surfactant being present in the amount of approximately 1% to 3% by volume; and hydrophilic molecules present in the amount of approximately 1% to 3% by volume.

4. An additive according to claim 2, wherein:

said aromatic hydrocarbon is present in the amount of approximately 1% to 3% by volume;

said vapor phase inhibitor is present in the amount of approximately 5% to 8% by volume;

said surfactant is present in the amount of approximately 1% to 3% by volume; and said hydrophilic molecules are present in the amount of approximately 1% to 3% by volume.

5. An additive according to claim 1, wherein:

said hydrocarbon mixture is present in the amount of approximately 75% by volume;

said vapor phase inhibitor is present in the amount of approximately 8% by volume;

said surfactant is present in the amount of approximately 3% by volume;

said alkyl amine is present in the amount of approximately 8% by volume; and there are included hydrophilic molecules in the amount of approximately 1% by volume, an aromatic hydrocarbon in the amount of approximately 3% by volume, and a ketone in the amount of approximately 2% by volume.

6. An additive according to claim 1, wherein:

said hydrocarbon mixture is present in the amount of approximately 78% by volume;

said vapor phase inhibitor is present in the amount of approximately 8% by volume;

said surfactant is present in the amount of approximately 3% by volume;

said alkyl amine is present in the amount of approximately 8% by volume; and there are included hydrophilic molecules in the amount of approximately 1% by volume, and an aromatic hydrocarbon in the amount of approximately 2% by volume.

7. An additive according to claim 1, wherein:

said vapor phase inhibitor comprises sodium lauryl sulfate.

8. An additive according to claim 1, wherein:

said vapor phase inhibitor comprises an amine phosphate.

9. An additive for LPG according to claim 1, wherein:

said hydrocarbon mixture is stoddard solvent.

10. An additive for LPG according to claim 2, wherein:

said vapor phase inhibitor is sodium lauryl sulfate.

11. An additive for LPG according to claim 1, wherein:

said surfactant is magnesium lauryl sulfate.

12. An additive for LPG according to claim 2, wherein:

said surfactant is magnesium lauryl sulfate.

13. An additive for LPG according to claim 9, wherein:

said surfactant is magnesium lauryl sulfate.

14. An additive for LPG according to claim 10, wherein:

said surfactant is magnesium lauryl sulfate.

15. An additive for LPG according to claim 2, wherein:

said aromatic hydrocarbon is Kari-Butyl Terpines.

16. An additive for LPG according to claim 15, wherein:

said hydrocarbon mixture is stoddard solvent.

17. An additive for LPG according to claim 16, wherein:

said vapor phase inhibitor is sodium lauryl sulfate.

18. An additive for LPG, wherein said additive comprises the following active components:

a hydrocarbon mixture being present in the amount of 78% by volume;

a vapor phase inhibitor being present in the amount of 8% by volume;

a surfactant being present in the amount of 3% by volume;

alkyl amines being present in the amount of 8% by volume;

hydrophilic molecules being present in the amount of 1% by volume; and an aromatic hydrocarbon being present in the amount 2% by volume.

* * * * *